US009827456B2

(12) United States Patent
McManama

(10) Patent No.: US 9,827,456 B2
(45) Date of Patent: Nov. 28, 2017

(54) FIREFIGHTING EQUIPMENT INSPECTION NOTIFICATION DEVICE

(71) Applicant: James Aaron McManama, Longwood, FL (US)

(72) Inventor: James Aaron McManama, Longwood, FL (US)

( * ) Notice: Subject to any disclaimer, the term of this patent is extended or adjusted under 35 U.S.C. 154(b) by 0 days.

(21) Appl. No.: 14/283,927

(22) Filed: May 21, 2014

(65) Prior Publication Data

US 2015/0335927 A1 Nov. 26, 2015

(51) Int. Cl.

| | |
|---|---|
| ***G08B 3/00*** | (2006.01) |
| ***G08B 7/00*** | (2006.01) |
| ***G08B 23/00*** | (2006.01) |
| ***G08B 21/00*** | (2006.01) |
| ***E05B 45/06*** | (2006.01) |
| ***G08B 1/00*** | (2006.01) |
| ***G10K 1/064*** | (2006.01) |
| ***G10K 1/067*** | (2006.01) |
| ***A62C 37/50*** | (2006.01) |
| ***A62C 13/76*** | (2006.01) |

(52) U.S. Cl.

CPC ..... *A62C 37/50* (2013.01); *A62C 13/76* (2013.01)

(58) Field of Classification Search

CPC ..... A62C 13/76; A62C 37/50; A61N 1/39; G08B 7/062; G08B 13/149; G08B 13/2417; G08B 21/02

See application file for complete search history.

(56) References Cited

U.S. PATENT DOCUMENTS

| | | | | |
|---|---|---|---|---|
| 3,145,375 | A * | 8/1964 | Webb | 340/568.8 |
| 4,418,336 | A * | 11/1983 | Taylor | G08B 13/149 169/51 |
| 4,613,851 | A * | 9/1986 | Hines | 340/688 |
| 5,378,171 | A * | 1/1995 | Czerlanis | 439/425 |
| 5,460,228 | A * | 10/1995 | Butler | 169/30 |
| 5,775,430 | A * | 7/1998 | McSheffrey | 169/30 |
| 6,029,863 | A * | 2/2000 | Ogram | 222/402.15 |
| 6,125,940 | A * | 10/2000 | Oram | 169/23 |
| 6,225,914 | B1 * | 5/2001 | Weng | 340/692 |
| 6,411,204 | B1 * | 6/2002 | Bloomfield et al. | 340/467 |
| 6,812,825 | B1 * | 11/2004 | Volk | G07C 5/006 340/309.16 |
| 2003/0116329 | A1 * | 6/2003 | McSheffrey et al. | 169/30 |
| 2003/0218539 | A1 * | 11/2003 | Hight | 340/539.13 |
| 2004/0008585 | A1 * | 1/2004 | Augspurger | G04B 37/1486 368/101 |
| 2004/0065451 | A1 * | 4/2004 | McSheffrey et al. | 169/75 |
| 2005/0231354 | A1 * | 10/2005 | Riedel | A61N 1/39 340/531 |
| 2005/0231365 | A1 * | 10/2005 | Tester et al. | 340/568.1 |
| 2005/0237210 | A1 * | 10/2005 | McSheffrey et al. | 340/614 |
| 2007/0008304 | A1 * | 1/2007 | Tobin | G06F 3/033 345/179 |
| 2007/0130735 | A1 * | 6/2007 | Diamond et al. | 24/636 |

(Continued)

*Primary Examiner* — Steven Lim
*Assistant Examiner* — Muhammad Adnan
(74) *Attorney, Agent, or Firm* — Allen, Dyer, Doppelt & Gilchrist, P.A.

(57) ABSTRACT

The present invention is directed to a firefighting equipment inspection notification device that includes a main body for housing a processor that is conventionally connected to an internal memory, a timer, an input/output unit, a visual indication unit, a power source and a wireless communication unit.

18 Claims, 3 Drawing Sheets

(56) References Cited

U.S. PATENT DOCUMENTS

| | | | | |
|---|---|---|---|---|
| 2008/0021919 | A1* | 1/2008 | Kaartinen | G06Q 10/087 |
| 2008/0108261 | A1* | 5/2008 | Swan | G06Q 10/087<br>441/89 |
| 2009/0174547 | A1* | 7/2009 | Greene et al. | 340/539.13 |
| 2009/0199857 | A1* | 8/2009 | Peake | A61M 16/06<br>128/206.28 |
| 2009/0201773 | A1* | 8/2009 | Wilson | G04F 1/005<br>368/108 |
| 2013/0197951 | A1* | 8/2013 | Watson et al. | 705/7.12 |
| 2014/0123420 | A1* | 5/2014 | Nanda | 15/105 |

* cited by examiner

FIREFIGHTING EQUIPMENT INSPECTION NOTIFICATION DEVICE

TECHNICAL FIELD

The present invention relates generally to firefighting equipment, and more particularly to a device for notifying a user that a portable fire extinguisher and/or fire suppression system is due for inspection.

BACKGROUND

The statements in this section merely provide background information related to the present disclosure and may not constitute prior art.

Any public building or business location within the United States is required to have some form of firefighting equipment. For example, apartments and office buildings typically have multiple portable fire extinguishers placed throughout the building at locations selected for reasonably easy access in a fire emergency. Likewise, restaurants typically have some form of overhead fire suppression system which are connected to a centrally located pressurized extinguisher, and function to blanket a stove or other portion of the kitchen with a fire retardant chemical.

Standards and procedures for periodic inspection of such equipment are set forth by the National Fire Protection Association (NFPA), and are augmented by state and local fire marshals. As such, it is imperative that firefighting equipment be physically inspected at regular intervals to ensure optimal performance. Although the timeline and inspection guidelines vary depending on the type of equipment involved, physical inspections typically check the following items: (a) Location in designated place (b) No obstruction to access or visibility (c) Operating instructions on nameplate legible and facing outward (d) Safety seals and tamper indicators not broken or missing (e) Fullness determined by weighing or "hefting" (f) Examination for obvious physical damage, corrosion, leakage, or clogged nozzle, and (g) Pressure gauge reading or indicator in the operable range or position.

Although mandates are established as described above, it is ultimately the responsibility of a building owner/occupant to ensure these standards are met. As such, inspection of these systems is typically performed by a licensed fire safety inspector who is hired to certify compliance with all fire safety guidelines. These inspectors can be under contract with a building owner to automatically perform the required inspections, or can be called when needed.

However, because the only current means for determining and recording inspections involves a written card that is hung from the device, it is not uncommon for building owners to forget to schedule an inspection. Moreover, some unscrupulous building owners may attempt to save money by forging a signature on the inspection card, when no actual inspection has occurred. In these situations, building occupants can find themselves in a situation where the firefighting equipment is out of date, and/or inoperable when it is needed most.

In addition to the above, there are known complex systems for remotely networking and monitoring the status of various types of firefighting equipment. However, such systems are extremely complex, do not typically provide a visual indicator on the actual device, and are so expensive as to be cost prohibitive for smaller buildings and business entities to employ.

Accordingly, it would be beneficial to provide a single device that is capable of quickly and easily securing to any type of firefighting equipment such as a fire extinguisher and/or fire suspension system, in order to provide an immediate visual notification to a user regarding the inspection status of the equipment, and without the drawbacks of the above noted devices.

SUMMARY OF THE INVENTION

The present invention is directed to a firefighting equipment inspection notification device. One embodiment of the present invention can include an outer shell/main body which can be physically secured to a piece of firefighting equipment. The device can include a visual notification unit which can notify a user about the inspection status of the equipment to which the device is attached.

The device can also include an input/output device capable of communicating with an external device such as a fire safety inspectors computer, for example, in order to receive instructions and to reset an internally located timer.

Another embodiment of the device can also include a tamper sensor which can function to activate the notification unit in the event the device is damaged or removed from the equipment.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
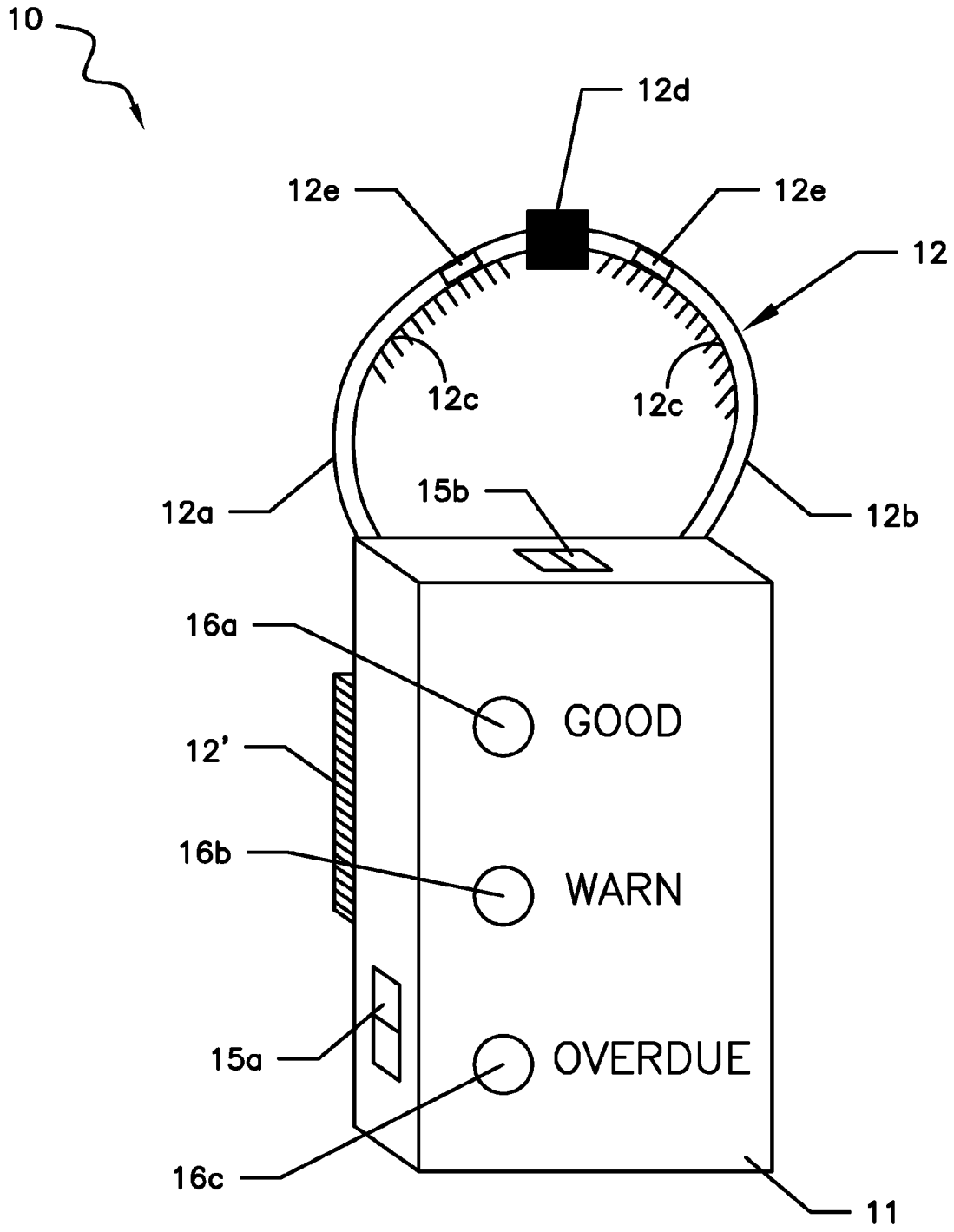
FIG. 1 is a frontal view of a firefighting equipment inspection notification device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although described with respect to a fire extinguisher and/or fire suppression system, the invention is not so limited. As such, the device can function with any form of firefighting equipment/device which requires a periodic inspection. Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
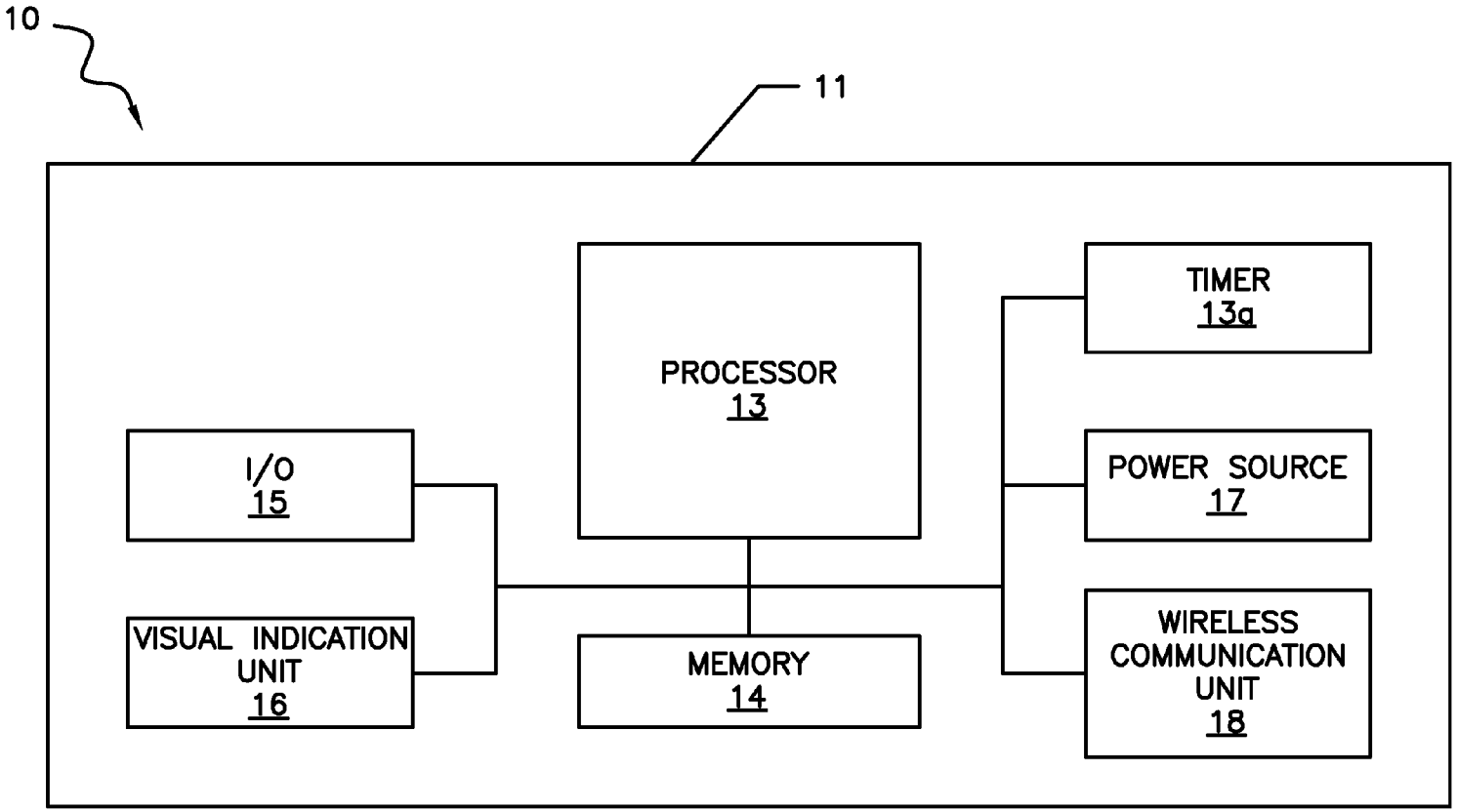
FIG. 2 is a simplistic block diagram of the firefighting equipment inspection notification device, in accordance with one embodiment of the invention.
Figure 3:
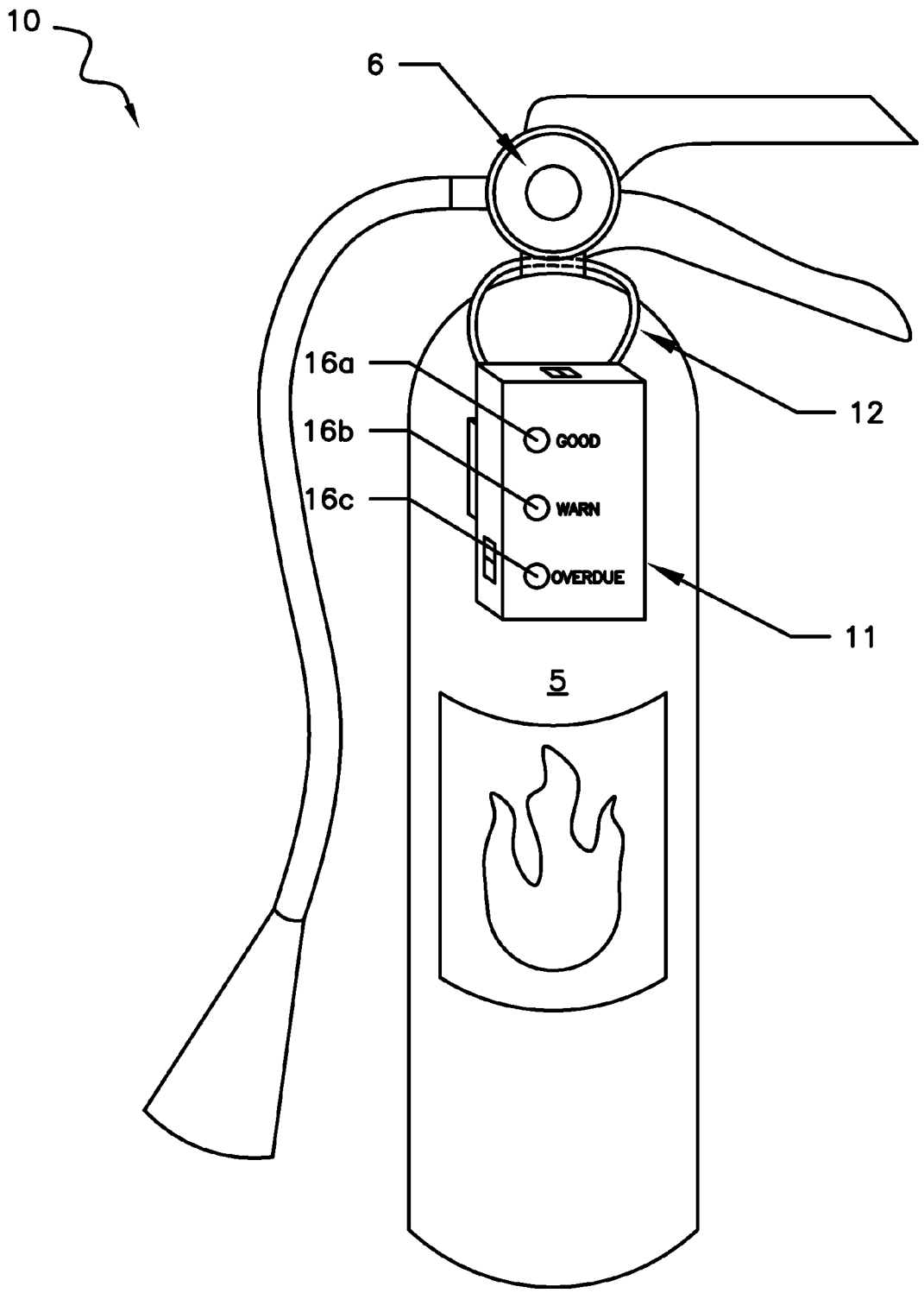
FIG. 3 is a perspective view of the firefighting equipment inspection notification device in operation, and in accordance with one embodiment of the invention.

FIGS. 1-3 illustrate one embodiment of a firefighting equipment inspection notification device 10 that is useful for understanding the inventive concepts disclosed herein. As shown, the device can include a main body 11 having a processor 13 that is conventionally connected to a timer 13*a*, an internal memory 14, an input/output unit 15, a visual indicator 16, a power source 17, and/or an optional wireless communication unit 18.

Although illustrated as separate elements, those of skill in the art will recognize that one or more system components may be, or include one or more printed circuit boards (PCB) containing an integrated circuit or circuits for completing the activities described herein. The CPU may be one or more integrated circuits having firmware for causing the circuitry to complete the activities described herein.

The main body 11 can house each of the elements 13-18 in a conventional manner, so as to create a single device. In this regard, the main body 11 can take any number of different shapes and sizes, and can be constructed from any number of different materials and methods. In one preferred embodiment, the main body 11 can be constructed from injection molded plastic having a plurality of internal connectors (not shown) for securely housing each of the device elements. In this regard, the main body will preferably be extremely lightweight so as to not interfere with the operation of the extinguisher to which it is attached. Of course, other known construction materials such as PVC and composites, for example, are also contemplated.

An attachment ring 12 can extend outward from the main body 11 in order to physically secure the device 10 onto a piece of firefighting equipment, such as the fire extinguisher 5 illustrated in FIG. 3. In one embodiment, the attachment ring 12 can include a pair of semi-flexible arms 12*a* and 12*b* having a plurality of teeth 12*c* which can be engaged by a pawl 12*d*, in order to form a loop which can be tightened onto the extinguisher at a conspicuous location, such as adjacent to the pressure gauge 6, for example.

In another embodiment, the ring 12 can further include a tamper sensor 12*e* such as a contact sensor, for example, which can function to send a tamper notification signal to the processor in the event that the pawl 12*d* has been disengaged and/or that either of the ring arms 12*a* and 12*b* have been cut or damaged. When so notified, the processor 13 can function to activate the notification unit 16 in order to present a visual indication that the device needs to be inspected. Such a feature can function as a safety mechanism to prevent unauthorized users from tampering with or removing the device 10 from a particular piece of firefighting equipment.

Although described above as including a ring, those of skill in the art will recognize that any number of secondary securing elements 12' can also be utilized either in place of, or in addition to the attachment ring 12. Several non-limiting examples include, strips of hook and loop material (i.e. Velcro®), adhesives such as glue, tape and resin, as well as compression fittings such as snaps and buttons, for example.

The processor/CPU 13 can act to execute program code stored in the memory 14 in order to allow the device to perform the functionality described herein. A timer module 13*a* can be provided, and can function to accurately measure the passage of time. As described herein, the timer module can be provided as a function of the processor or can include a separate physical circuit. In either instance, processors and timers are extremely well known in the art, therefore no further description will be provided.

Memory 14 can act to store operating instructions in the form of program code for the processor 13 to execute. Although illustrated in FIG. 2 as a single component, memory 14 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 14 can also include one or more cache memories that provide temporary storage of at least some program code in order to reduce the number of times program code must be retrieved from the bulk storage device during execution. Each of these devices are well known in the art.

The device 10 can include any suitable power source 17 capable of providing the necessary power requirements to each element of the device 10. In one embodiment, the power source can include one or more DC batteries which can be installed within the main body and accessible via a removable cover (not illustrated) for ease of replacement.

The input/output unit 15 can function to send and receive information between a user and the processor 13. In one embodiment, the input/output unit can include a USB port 15*a* which can interface with an external device such as a fire safety inspector's computer, for example, in order to allow the inspector to retrieve information about the firefighting equipment and/or to reset the timer function of the processor. In another embodiment, the device 10 can also include one or more push buttons 15*b* which can be positioned along the main body 11, in order to receive direct instructions from a user. For example, in one embodiment, the push button(s) 15*b* can function to instruct the processor to activate the visual indication unit 16, in order to display an inspection status of the device on demand.

Although described above as including specific features and/or functionality, this is for illustrative purposes only, as virtually any type of device capable of sending and/or receiving information and/or instructions with the processor of the device 10 are contemplated. For example, in another embodiment, the device 10 can also include a wireless communication unit 18, which can function to communicate wirelessly with an external device either directly or over a network. In the preferred embodiment, the wireless communication unit can include Bluetooth transceiver for communicating wireles sly with an external device such as a smartphone, computer and/or tablet device running an App or program. However, any number of other known transmission and reception mechanisms and protocols can also be utilized herein, several nonlimiting examples include unique radio frequencies, infrared (IR), RFID, and/or a network adapter functioning to communicate over a WAN, LAN or the internet via an internet service provided.

In this regard, the device 10 can include programming for allowing the processor to only communicate with an authorized fire safety inspector, in order to prevent anyone else from resetting the timer and changing an inspection notification status, as described below. Such programming can include password protection and/or unique computer code that is available only to authorized fire equipment inspection services and technicians.

The visual indication unit 16 can function to provide a visual indication about the inspection status of the firefighting equipment to which the device 10 is attached. In one embodiment, the visual indication unit 16 can include a plurality of light emitting diodes (LED's) such as a green light 16*a*, a yellow light 16*b* and a red light 16*c*, for example. The visual indication unit 16 can be controlled by the processor, and can function to illuminate one or more of the lights 16*a*-16*c* based on an input from the timer and/or the input/output unit 15.

In order to illustrate the functionality of the device 10, the following paragraph will describe one operation of the device 10 for notifying users about the inspection status of a piece of firefighting equipment that must be inspected every 12 months. In this regard, upon receiving a reset signal from an authorized technician, the processor 13 can instruct the green light 16*a* of the visual indication unit 16 to remain illuminated for a first period of time, such as but not limited to 11 months, for example. Illumination of the green light can function to notify users that the firefighting equipment has been inspected within the required timeframe. Next, when the timer determines that the first period of time has passed, the processor can instruct the yellow light 16*b* to illuminate for a second period of time, such as but not limited to 30 days, for example. Illumination of the yellow light can function to warn a user that the firefighting equipment is due for inspection shortly. Finally, when the timer determines that the second period of time has passed, the processor can instruct the red light 16*c* to illuminate continuously, unless and until the device is reset by an authorized user. Illumination of the red light can function to notify a user that the firefighting equipment is overdue for inspection and may not be functioning correctly.

Although described above as using particular lights, colors and timeframes, this is for illustrative purposes only, as any number of different colored lights can be employed by the device, and each one can be selectively activated in accordance with any timeframe. In this regard, each of the lights can function to remain illuminated constantly, or can blink. Additionally, the device can include programming so as to only illuminate a particular light when the button 15*b* is depressed, thereby prolonging the life of the batteries.

Accordingly, the firefighting equipment inspection notification device 10 can function to mate with any number of different types of firefighting equipment, and can be programmed to provide a visual indicator regarding the inspection status of the equipment. Additionally, since the device can receive unique user instructions, it is possible for a single device to be mass produced in order to function with firefighting equipment having different inspection timelines. Finally, because access to the device is restricted to authorized personnel, the device is resistant to attempts by unscrupulous persons to reset the visual indicator, in order to avoid costs of performing the mandated equipment inspection.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An inspection notification device for firefighting equipment comprising:

a main body;

an attachment ring extending outwards from said main body and comprising a pair of flexible arms, with each arm having a plurality of teeth thereon, and a pawl configured to engage the plurality of teeth on said pair of flexible arms so as to form a loop which can be tightened onto the firefighting equipment to be inspected;

an input/output carried by said main body and configured to receive a reset signal from a fire safety inspector's computer;

a timer carried by said main body and configured to determine, based on receiving the reset signal, when a plurality of inspection time periods have passed, with the plurality of inspection time periods including first and second inspection time periods;

an inspection status visual indication unit carried by said main body and configured to provide a visual indication about an inspection status of the firefighting equipment to which said main body is attached, said inspection status visual indication unit comprising a plurality of green, yellow and red inspection status lights; and a processor carried by said main body and coupled to said input/output, said timer, and said inspection status visual indication unit, and configured to perform the following:

illuminate said green inspection status light based on receiving the reset signal, with said green inspection status light indicating that the firefighting equipment has been inspected within a required timeframe, illuminate said yellow inspection status light after the first inspection time period has passed indicating that the firefighting equipment is due for inspection, and illuminate said red inspection status light after the second inspection time period has passed indicating that the firefighting equipment is overdue for inspection.

2. The inspection notification device according to claim 1 wherein said attachment ring further comprises at least one tamper sensor configured to send a tamper notification to said processor based on at least one of said pawl being disengaged and either of said flexible arms being cut or damaged.

3. The inspection notification device according to claim 2 wherein said processor is further configured to illuminate said red inspection status light based on receiving the tamper notification.

4. The inspection notification device according to claim 1 further comprising a memory carried by said main body and coupled to said input/output and said processor, and configured to store information about the firefighting equipment to be inspected.

5. The inspection notification device according to claim 1 wherein said input/output is further configured to wirelessly receive the reset signal from the fire safety inspector's computer.

6. The inspection notification device according to claim 1 wherein said main body comprises thermoplastic.

7. An inspection notification device for firefighting equipment comprising:

a main body;

an attachment configured to secure said main body onto the firefighting equipment to be inspected;

an input/output carried by said main body and configured to receive an externally generated reset signal;

a timer carried by said main body and configured to determine, based on receiving the reset signal, at least one inspection time period;

an inspection status visual indication unit carried by said main body and configured to provide a visual indication about an inspection status of the firefighting equipment to which said main body is attached, said inspection status visual indication unit comprising first and second inspection status lights; and a processor carried by said main body and coupled to said input/output, said timer, and said inspection status visual indication unit, and configured to perform the following:

illuminate said first inspection status light based on receiving the reset signal, with said first inspection status light indicating that the firefighting equipment has been inspected, and illuminate said second inspection status light after the at least one inspection time period has passed indicating that the firefighting equipment is overdue for inspection.

8. The inspection notification device according to claim 7 wherein the at least one inspection time period includes at least one intermediate time period that is less than the at least one inspection time period; and wherein said inspection status visual indication unit further comprises at least one intermediate inspection status light; and wherein said processor is further configured to perform the following:

illuminate said at least one intermediate inspection status light after the at least one intermediate time period has passed indicating that the firefighting equipment is due for inspection.

9. The inspection notification device according to claim 7 wherein said attachment comprises an attachment ring extending outwards from said main body and comprising a pair of flexible arms, with each arm having a plurality of teeth thereon; and a pawl configured to engage the plurality of teeth on said pair of flexible arms so as to form a loop which can be tightened onto the firefighting equipment.

10. The inspection notification device according to claim 9 wherein said attachment ring further comprises at least one tamper sensor configured to send a tamper notification to said processor based on at least one of said pawl being disengaged and either of said flexible arms being cut or damaged.

11. The inspection notification device according to claim 10 wherein said processor is further configured to illuminate said second inspection status light based on receiving the tamper notification.

12. The inspection notification device according to claim 7 wherein said attachment comprises hook and loop material.

13. The inspection notification device according to claim 7 further comprising a memory carried by said main body and coupled to said input/output and said processor, and configured to store information about the firefighting equipment to be inspected.

14. The inspection notification device according to claim 7 wherein said input/output comprises a universal serial bus (USB) port.

15. The inspection notification device according to claim 7 wherein said input/output is further configured to wirelessly receive the reset signal.

16. The inspection notification device according to claim 7 further comprising at least one status input carried by said main body and coupled to said processor, with said processor being further configured to activate said inspection status visual indication unit so as to display an inspection status upon operation of said at least one status input.

17. The inspection notification device according to claim 7 wherein said main body comprises thermoplastic.

18. The inspection notification device according to claim 7 wherein said first inspection status light comprises a green light, said second inspection status light comprises a red light.

* * * * *